US007296308B2

(12) United States Patent
Turner

(10) Patent No.: US 7,296,308 B2
(45) Date of Patent: Nov. 20, 2007

(54) SWIMMING POOL WATER CIRCULATOR

(76) Inventor: John B. Turner, 91 Brentwood Dr., Penfield, NY (US) 14526

( * ) Notice: Subject to any disclaimer, the term of this patent is extended or adjusted under 35 U.S.C. 154(b) by 402 days.

(21) Appl. No.: 10/880,699

(22) Filed: Jun. 30, 2004

(65) Prior Publication Data

US 2005/0028265 A1 Feb. 10, 2005

Related U.S. Application Data

(60) Provisional application No. 60/485,171, filed on Jul. 2, 2003.

(51) Int. Cl.
*E04H 4/00* (2006.01)

(52) U.S. Cl. ..... 4/507; 4/490; 4/492; 239/390; 239/394; 239/550

(58) Field of Classification Search ..... 4/490, 4/492, 507, 541.1, 541.3, 541.6; 239/548, 239/550, 556, 390, 394, 396, 596; 210/167.1, 210/167.12–167.16
See application file for complete search history.

(56) References Cited

U.S. PATENT DOCUMENTS 3,261,371 A * 7/1966 Vernon ..... 210/167.12
4,393,526 A * 7/1983 Miller et al. ..... 4/490
4,501,659 A * 2/1985 Henk ..... 210/167.1
4,640,783 A * 2/1987 Kern ..... 4/490
4,809,369 A * 3/1989 Bowden ..... 4/596
5,848,444 A * 12/1998 Christopherson ..... 4/541.6
5,881,401 A * 3/1999 Saputo ..... 4/490
6,079,640 A * 6/2000 Merritts ..... 239/556
6,108,829 A * 8/2000 Wadsworth ..... 4/541.1
6,378,146 B1 * 4/2002 Johnston ..... 4/541.1
6,378,791 B1 * 4/2002 Perry et al. ..... 239/550

* cited by examiner

*Primary Examiner*—Tuan Nguyen
(74) *Attorney, Agent, or Firm*—Hiscock & Barclay, LLP

(57) ABSTRACT

The invention comprises, in one form thereof, a water circulator that connects to the pressurized water inlet in a swimming pool. Water from the pool is pumped through the pool's filter system and into the water circulator through the pool inlet. The water circulator includes a jet tube that is vertically oriented and proximate to the pool's side wall. The pressurized water exits the jet tube through several nozzles in the jet tube. The nozzles direct the pressurized water along the side wall to thereby direct debris toward the pool outlet. The pool outlet carries the debris and water to the pool's filter system. The nozzles direct the water away from the pool outlet so that the water current travels along the majority of the side wall before reaching the pool outlet. Thus, more debris may be picked up in the current and slower moving water passes the pool outlet. The jet tube further includes one or more outlets proximate to the pool floor. These outlets are directed towards the center of the pool so that the pressurized water stirs up debris and sediment on the floor.

10 Claims, 9 Drawing Sheets

SWIMMING POOL WATER CIRCULATOR

CROSS-REFERENCE TO RELATED APPLICATIONS

This application claims priority to U.S. Provisional Application Ser. No. 60/485,171, filed with the U.S. Patent and Trademark Office on Jul. 2, 2003.

FIELD OF THE INVENTION

This invention relates to swimming pool water circulation as a means for cleaning the pool water.

BACKGROUND OF THE INVENTION

One typical prior art swimming pool water circulation system is illustrated in FIG. 1. The prior art system includes an assembly 14 comprised of a strainer, a pump, and a filter.

In the prior art filtering system depicted in FIG. 1, the water in the swimming pool 12 first travels into an outlet port 26 of the swimming pool 12. The water withdrawn from pool 12 is fed into intake port 30 of assembly 14.

In FIG. 1, a substantially circular swimming pool 12 is depicted, however other shapes and sizes may be used for swimming pool 12. Thus, swimming pool 12 may be oval shaped, rectangular, square shaped, irregularly shaped, etc. Furthermore, the outlet port 26 may be disposed at a different location, and there may be a multiplicity of such outlet ports 26.

Referring again to FIG. 1, water entering intake port 30 of assembly 14 is circulated through the filter in assembly 14. Typically disposed within filter in assembly 14 is a filtering media 32. The precise location of the filter media and of the strainer, filter tank, pump, and other accessories typically used with these filtering systems will vary from one filter system to another. The filter in assembly 14 may include a sand filter, a diatomaceous earth filter, a cartridge filter, etc.

The water enters the intake port 30, passes through a strainer, a pump, and then the filter media 32 and exits via output port 34.

The cleaned water is then fed to a return water port 28. Such a return water port 28 is typically built into a sidewall 20 of pool 12. The water fed through return water port 28 then flows directly across the surface of the pool, typically in a pattern shown by the arrows.

Such a water circulation pattern does little if anything to agitate and gather up the sediment and debris 24 that typically rests on the floor 21 or that is suspended below the surface of the water.

Therefore, a swimming pool circulation system that effectively agitates the pool water is desired in the art.

SUMMARY OF THE INVENTION

The invention comprises, in one form thereof, a swimming pool water circulating system including a pool with an amount of water and a pressurized water inlet, a jet tube that is submerged in the water and in fluid communication with the water inlet, and a plurality of nozzles that penetrate the jet tube.

The jet tube is oriented in a substantially vertical direction and substantially parallel to the side wall of the pool. The nozzles direct the pressurized water in a direction that is parallel to the side wall and away from a pool skimmer/outlet. The jet tube also includes at least one outlet in the end of said tube proximate to the floor. These outlets are directed in a direction substantially perpendicular to the direction of the nozzles. A pump drives water from the pool skimmer/outlet through a strainer and filter media to the pressurized water inlet.

An advantage of the present invention is that a water current is developed along the sides of the pool and across the pool floor to thereby stir up debris and direct it toward the pool skimmer/outlet. The water current also circulates more of the pool water past the pool skimmer/outlet such that an increased amount of sediment and debris enters the pool's filter system and is removed.

BRIEF DESCRIPTION OF THE DRAWINGS

The above-mentioned and other features and advantages of this invention, and the manner of attaining them, will become apparent and be better understood by reference to the following description of particular embodiments of the invention in conjunction with the accompanying drawings, wherein.

Corresponding reference characters indicate corresponding parts throughout the several views. The examples set out herein illustrate several embodiments of the invention but should not be construed as limiting the scope of the invention in any manner.

DETAILED DESCRIPTION

Figure 1:
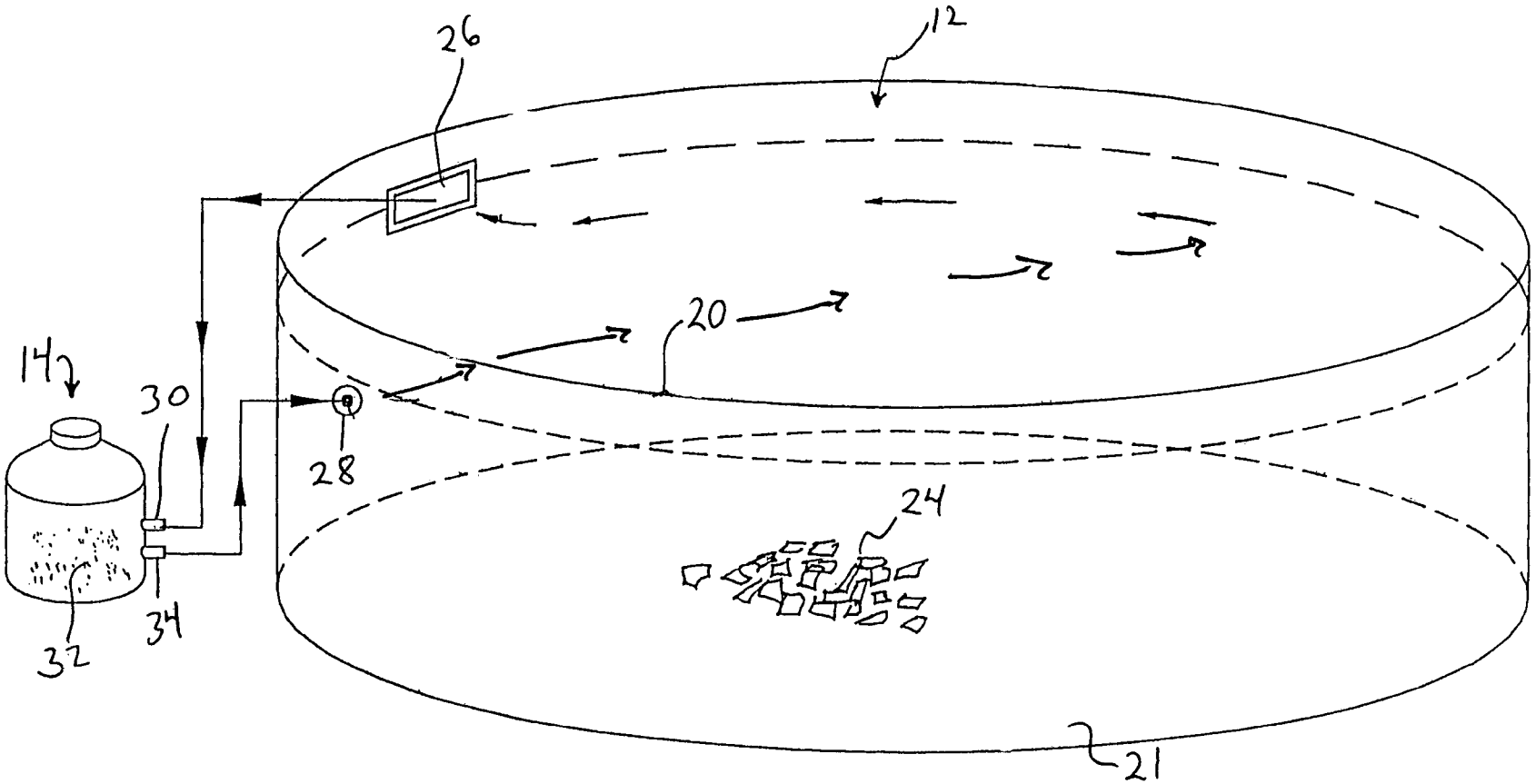
FIG. 1 PRIOR ART
FIG. 1 is an isometric view of a conventional swimming pool water circulation system according to the prior art.
Figure 2:
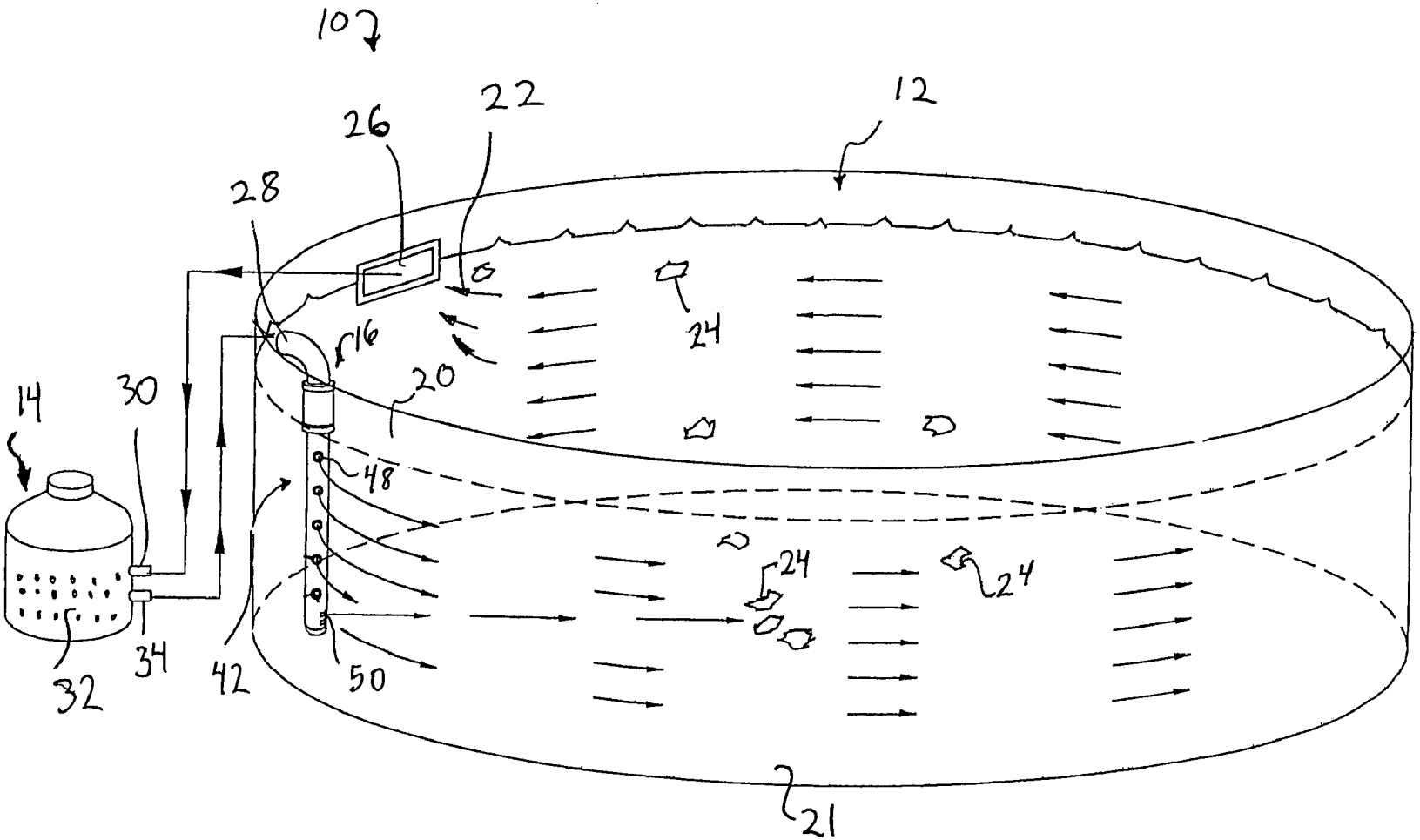
FIG. 2 is a isometric view of the swimming pool water circulation system of the present invention.

Referring to FIG. 2, there is shown the swimming pool water circulation system of the present invention. The circulation system 10 includes a pool 12, a filter and pump assembly 14, and a water circulator 16.

The swimming pool 12 includes a side wall 20 and floor 21, water 22, debris 24, skimmer/pool outlet 26, and pool inlet 28. The swimming pool 12 may be circular, elliptical, rectangular, irregularly shaped, etc. Further, the pool 12 may be an above-ground or in-ground pool. The debris 24 may be suspended in the water 22, as well as floating on top of the water and resting on the pool floor 21. In most pools, the skimmer/pool outlet 26 is located on the side wall 20, approximately centered at the surface of the water 22. The pool inlet 28 is conventionally located on the side wall 20 near the surface of the water 22 and offset in a counter-clockwise direction from the skimmer/pool outlet 26. In some cases, however, the pool inlet 28 is offset in a clockwise direction from the skimmer/pool outlet 26. The pool inlet 28 includes a through-the-wall assembly 29 shown in FIG. 3. The through-the-wall assembly 29 is internally threaded and is connected to a fluid passageway that is connected to the filter and pump assembly 14.

Filter and pump assembly 14, shown in FIG. 2, includes a filter intake 30, a strainer, a pump, filter media 32, and filter output 34. The filter intake 30 is in fluid communication with the skimmer/pool outlet 26. The strainer removes large debris from the water flow and the filter media 32 remove smaller debris and sediment from the water flow. The filter output 34 is in fluid communication with the pool inlet 28.

Figure 3:
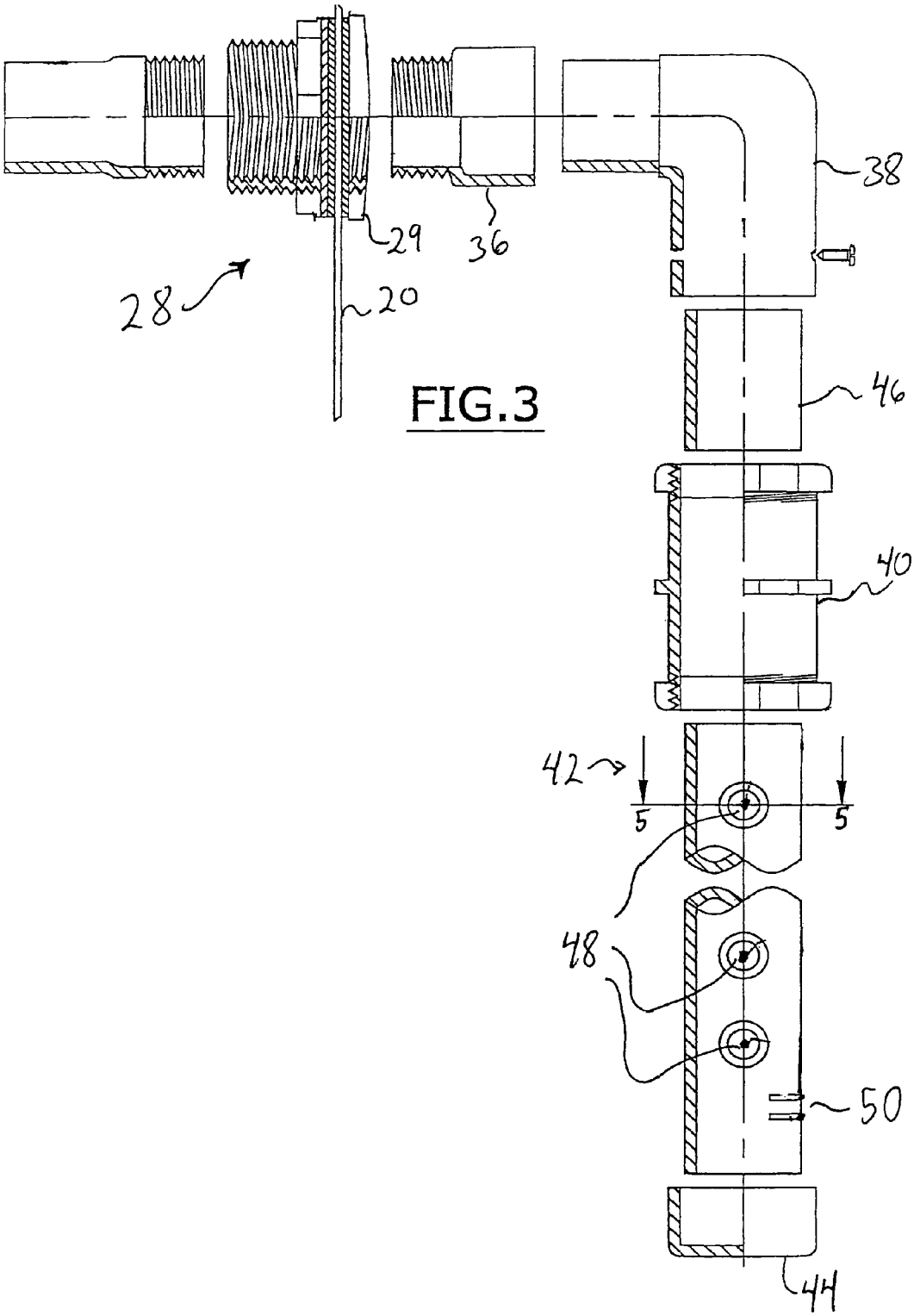
FIG. 3 is a partially cross-sectioned, exploded view of the water circulator of FIG. 2.

The water circulator 16 is affixed to the pool inlet 28. FIG. 3 displays the water circulator 16 in greater detail. The water circulator 16 includes an adaptor 36, an elbow 38, a coupler 40, a jet tube 42, and an end cap 44. The adaptor 36 is threaded into the through-the-wall assembly 29 of the pool inlet 28 or otherwise removably affixed to the pool inlet 28 in a substantially water-tight manner. The elbow 38 fits tightly within the adaptor 36 and is affixed to adaptor 36 with a set screw, an adhesive, or other suitable means. The elbow is oriented such that one end is directed towards the pool floor 21. The coupler 40 is removably affixed to the elbow 38 such as by threading the coupler 40 onto the elbow 38. Alternatively, a short tube 46 is affixed to the elbow 38 with a set screw, an epoxy, or other suitable means and the coupler 40 is removably affixed to the short tube 46. The jet tube 42 fits snugly into the coupler 40 and is removably affixed to the coupler 40 such as with a set screw or by threading the jet tube 42 into the coupler 40. The end cap 44 slides snugly onto the jet tube 42 and is affixed to the jet tube 42 with a set screw, an adhesive, by threading the end cap 44 onto the jet tube 42, or other suitable means.

Figure 4A:
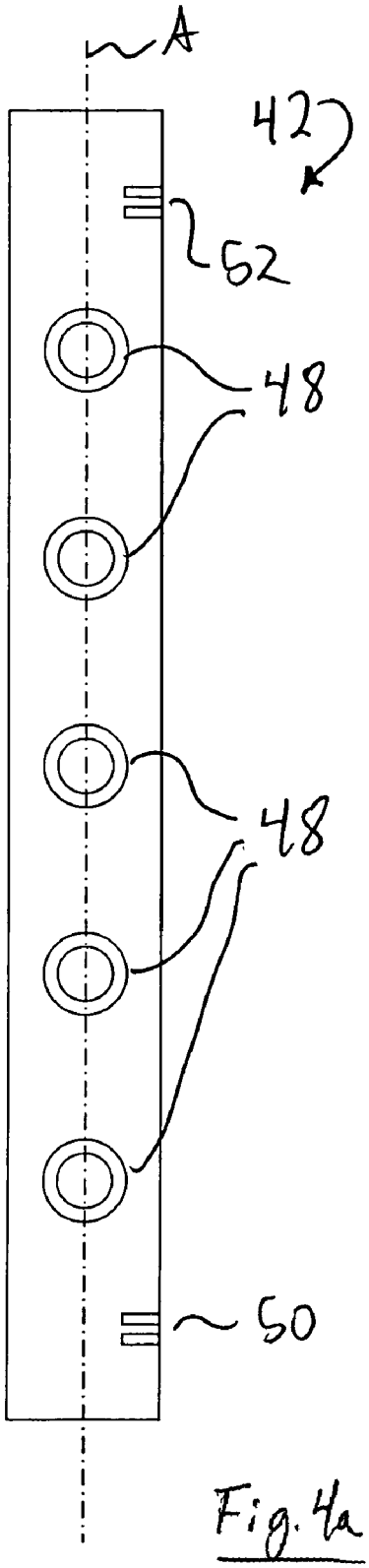
FIGS. 4*a* and 4*b* are side views of the jet tube of FIG. 3.
Figure 4B:
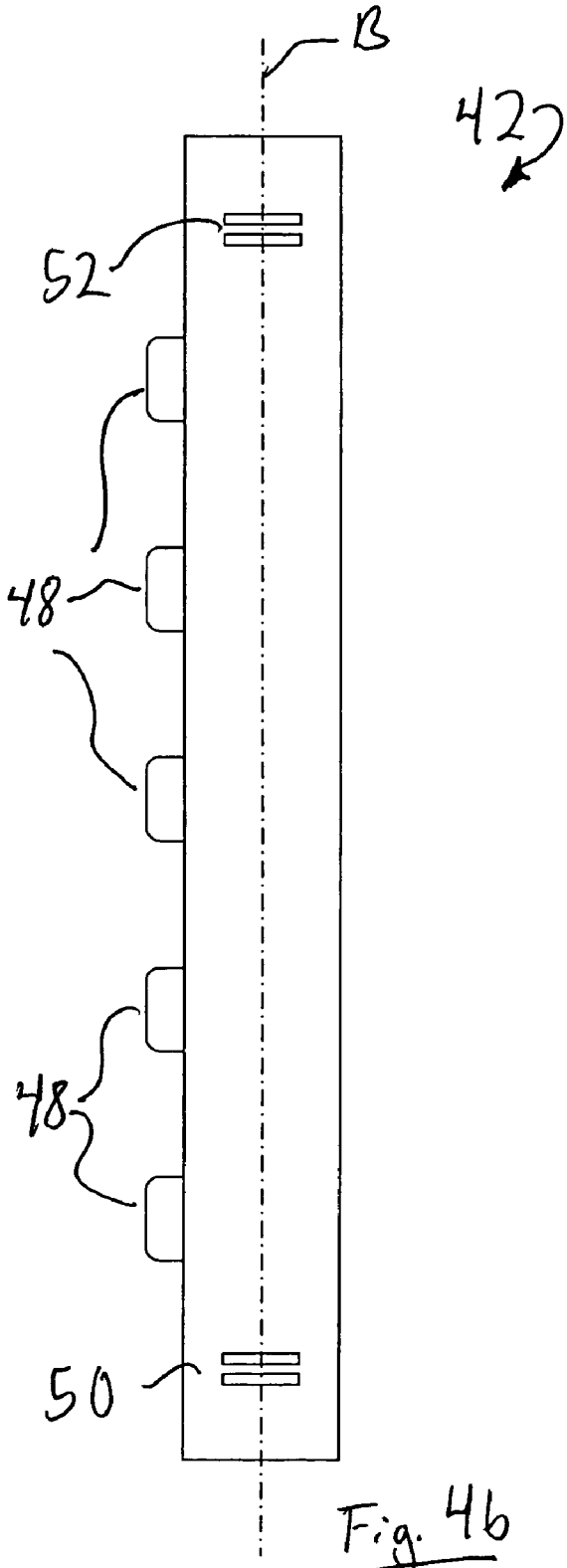

The jet tube 42 is shown in more detail in FIGS. 4*a* and 4*b*. The jet tube 42 includes a plurality of nozzles 48 having a centerline A, a first set of slots 50, and a second set of slots 52. By way of example, FIGS. 4*a* and 4*b* show a jet tube 42 having five nozzles 48 and two slots in each set of slots 50 and 52, however, the jet tube 42 may include any number of nozzles 48 and slots 50 and 52. For example, shallow pools may require a shorter jet tube 42 and fewer nozzles 48 than shown in FIGS. 4*a* and 4*b*. The first set of slots 50 and the second set of slots 52 are centered on centerline B. Centerline B is located approximately 90 degrees along the circumference of the cross-section of the jet tube 42 from centerline A. Thus, when the nozzles 48 are positioned parallel to the side wall 20, the slots 50 and 52 may face the center of the pool 12.

The jet tube 42 is preferably positioned such that the nozzles 48 are aimed parallel to the side wall 20 and face away from the skimmer/pool outlet 26. In most pools, such as the one shown in FIG. 2, the pool inlet 28 is offset in the counter-clockwise direction from the skimmer/pool outlet 26. In this configuration, the end of the jet tube 42 associated with the second set of slots 52 is inserted into the coupler 40 such that the slots 52 are completely covered by coupler 40. The end cap 44 is affixed to the end of the jet tube 42 associated with the first set of slots 50 without covering the first set of slots 50. The nozzles 48 are oriented to be parallel to the side wall 20 and to direct the water flow in the counter-clockwise direction. Thus, in the present example, the nozzles 48 are directed away from the skimmer/pool outlet 26 and the first set of slots 50 are directed toward the center of the pool 12. In the case that the pool inlet 28 is offset in the clockwise direction from the skimmer/pool outlet 26, the end of the jet tube 42 associated with the first set of slots 50 is inserted into the coupler 40 such that the slots 50 are completely covered by coupler 40 and the nozzles 48 are directed in the clockwise direction, parallel to the sidewall 20. The end cap 44 is affixed to the end of the jet tube 42 that is associated with the second set of slots 52 without covering the second set of slots 52. Thus, in this configuration, the nozzles 48 are directed away from the skimmer/pool outlet 26 and the second set of slots 52 are directed toward the center of the pool 12.

Figure 5:
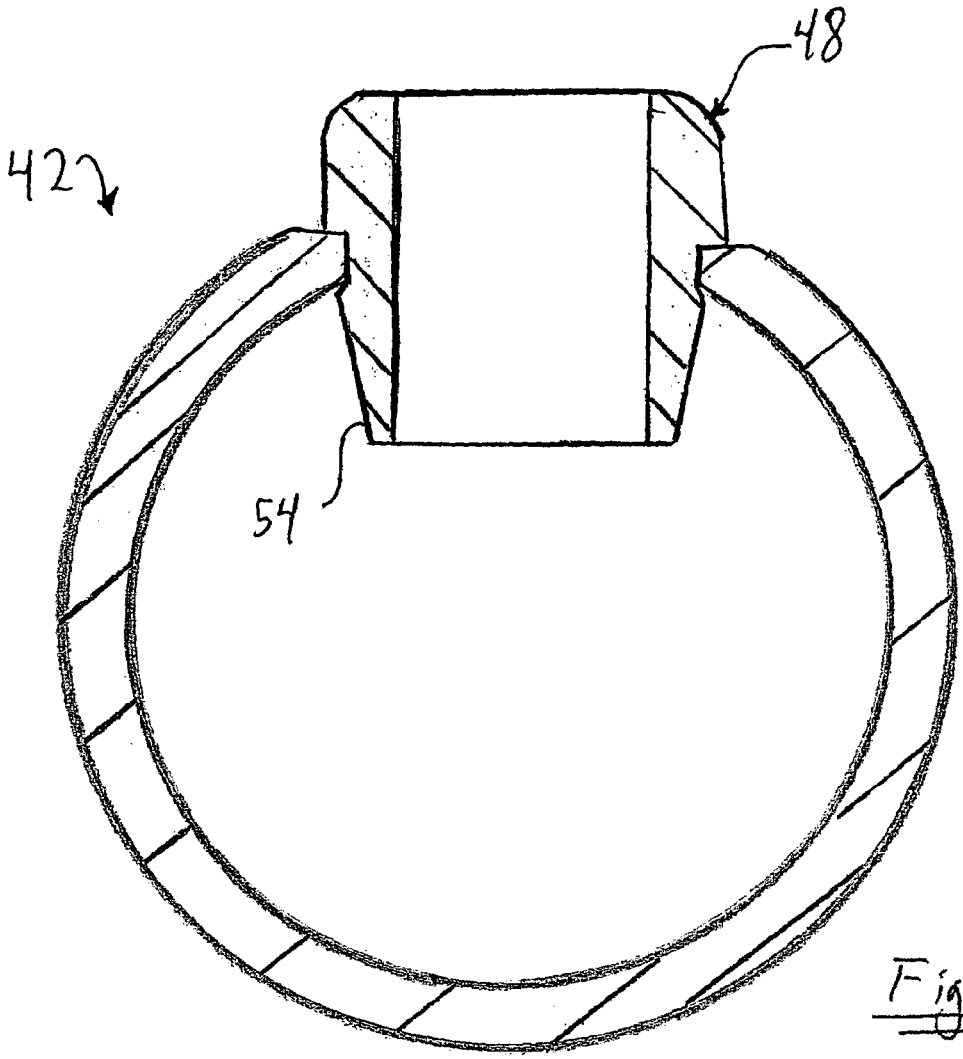
FIG. 5 is a cross-sectional view of the jet tube of FIG. 3.

FIG. 5 shows a detailed view of a nozzle opening in the jet tube 42 and a nozzle 48. The nozzle 48 includes a circular barb 54 such that nozzle 48 is snapped into the nozzle opening. The nozzle 48 may alternatively be affixed to the nozzle opening by an adhesive or another suitable method. In the present embodiment, the nozzle 48 is substantially cylindrical, however, the nozzle 48 may be configured in any shape. The cross-section of the jet tube 42 may be configured into alternate shapes as well.

In use, the pump in the filter assembly 14 drives filtered water through the filter output 34 to the pool inlet 28. This pressurized water flows through the water circulator 16 through the adapter 36, the elbow 38, the coupler 40, and into the jet tube 42. The pressurized water escapes the jet tube 42 through the nozzles 48 and the first set of slots 50 in the configuration shown in FIG. 2. The jets of pressurized water create a current in the pool water 22. The current travels along the side wall 20 toward the skimmer/pool outlet 26, as shown by the arrows in FIG. 2, and thus the current carries debris 24 to the skimmer/pool outlet 26. The pressurized water escaping the jet tube 42 though the first set of slots 50 travels along the pool floor 21 toward the center of the pool 12. This stirs up debris and sediment 24 resting on the floor 21 so that the debris and sediment 24 may be picked up by the current and carried in suspension toward the skimmer/pool outlet 26. The water 22 and debris 24 that travel through the skimmer/pool outlet 26 enter the filter assembly 14 through the filter intake 30. The debris 24 and other sediment are filtered out of the water 22 by the strainer and the filter media 32 and the cleaned water is then pumped through the filter output 34 to the pool inlet 28.

It should be particularly noted the water circulator 16 is preferably made of a polyvinyl chloride (PVC) such as schedule 40 PVC. Alternatively, the water circulator 16 may be made of stainless steel or any other material approved for use in swimming pools by NSF International.

Figure 6:
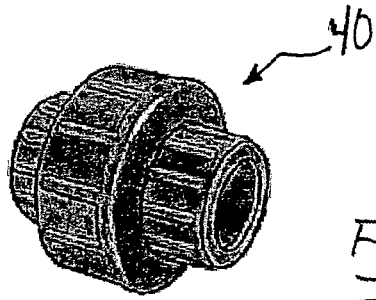
FIG. 6 is an isometric view of a pipe union.

It should be further particularly noted that the coupler 40 may be a compression coupler. The compression coupler includes a gasket affixed to the outer surface of the short tube 46 and a gasket affixed to the outer surface of the jet tube 42. A ring is threaded onto each end of the coupler, squeezing the gaskets against an inner wall of the compression coupler. Thus coupler 40 connects the short tube 46 to the jet tube 42. Alternatively, coupler 40 is a pipe union such as the one shown in FIG. 6. In a further alternative, the coupler 40 and the short tube 46 are not used and the jet tube 42 is affixed directly to the elbow 38.

Figure 7:
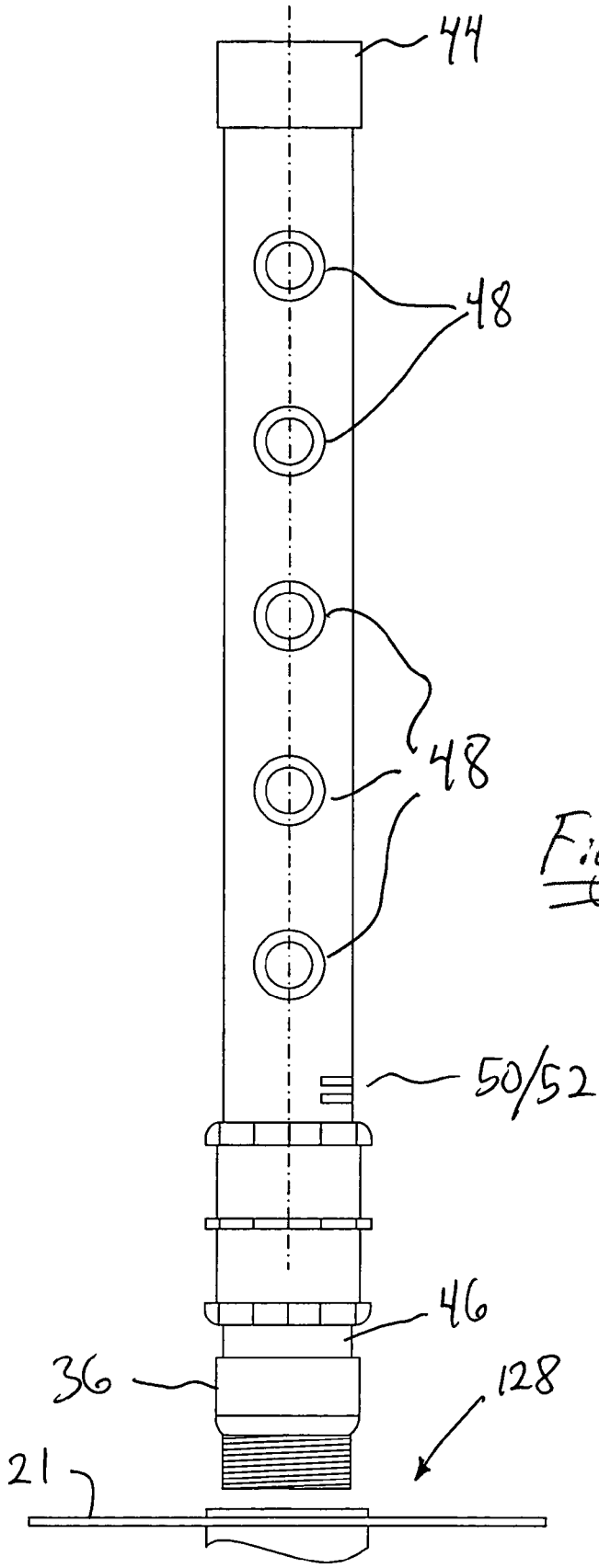
FIG. 7 is a side view of a jet tube according to a further embodiment of the invention wherein the pool inlet is on the floor of the pool.

In a further embodiment shown in FIG. 7, the pool 12 may have an inlet 128 on the pool floor 21. In this particular embodiment, the elbow 38 is removed and the short tube 46 is connected directly to the adaptor 36. Further, the slots 50 or 52 on the end of the jet tube 42 that is affixed to the coupler 40 are exposed to thereby allow the pressurized water to escape through those slots. The end cap 44 covers the slots 50 or 52 that are associated with the end of the jet tub 42 that is proximate to the surface of the water 22 such that pressurized water that is directed to the center of the pool 12 is directed along the floor 21, not the surface of the water 22. Alternatively, a set of slots are located in the adaptor 36 or the short tube 46 to be closer to the floor 21.

Figure 8A:
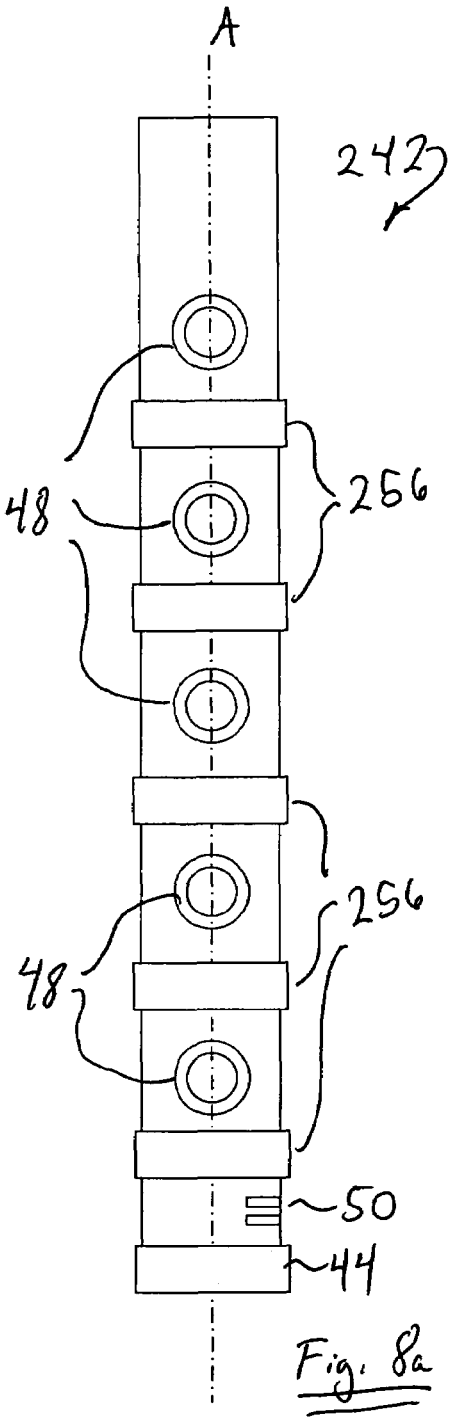
FIGS. 8*a* and 8*b* are side views of a jet tube having several rotating fixtures according to a further embodiment of the invention.
Figure 8B:
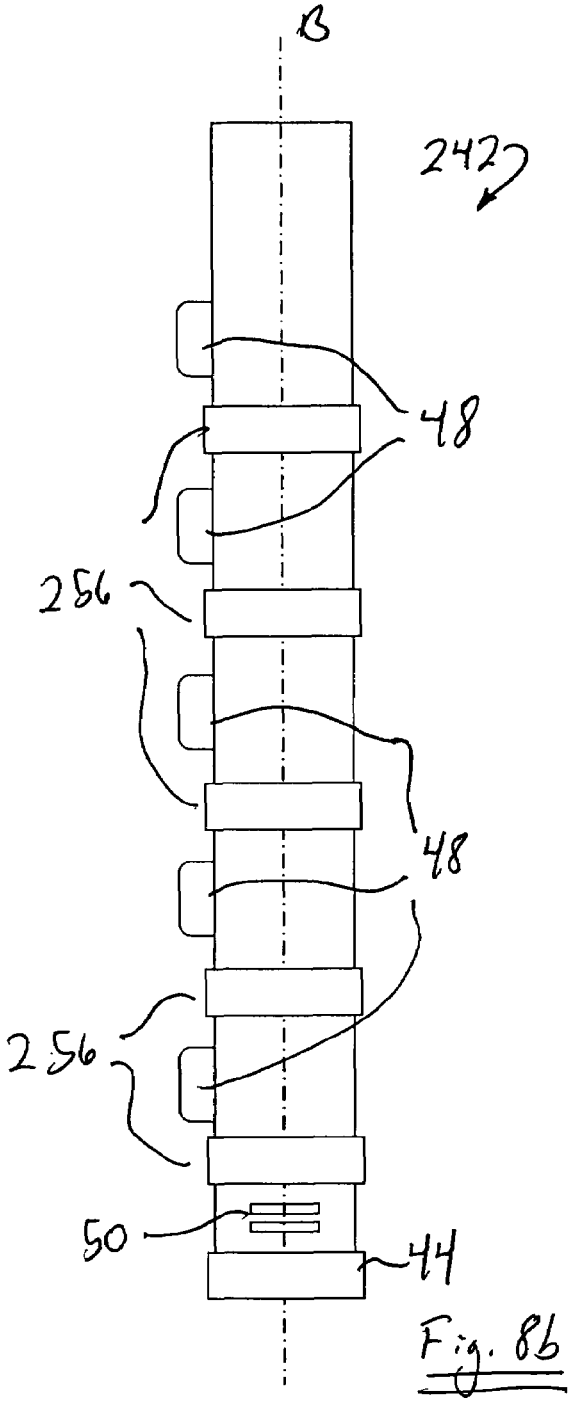

In a further embodiment shown in FIGS. 8*a* and 8*b*, the jet tube 242 is configured with rotating fixtures 256 between each of the nozzles 48. The fixtures 256 allow one to set the direction of each of the nozzles independently. Further, in this particular embodiment, separate nozzle segments may be added or removed to adjust the length of the jet tube 242 according to the depth of the pool 12. Each segment may include one or more nozzles 48.

Figure 9A:
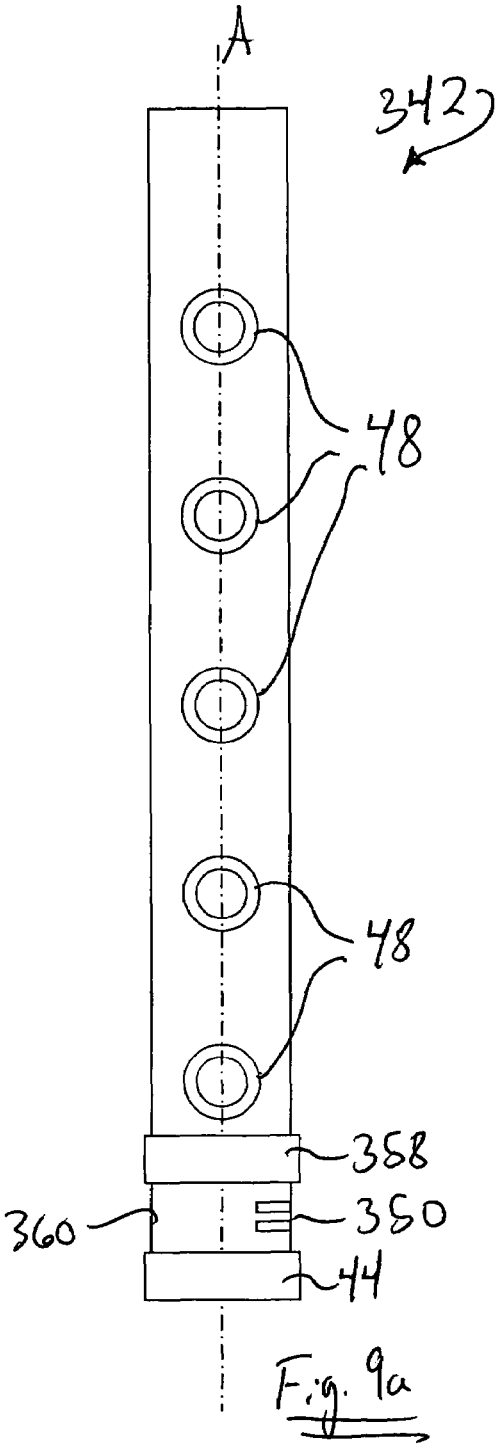
FIGS. 9*a* and 9*b* are side views of a jet tube having a rotating extension according to a further embodiment of the invention.
Figure 9B:
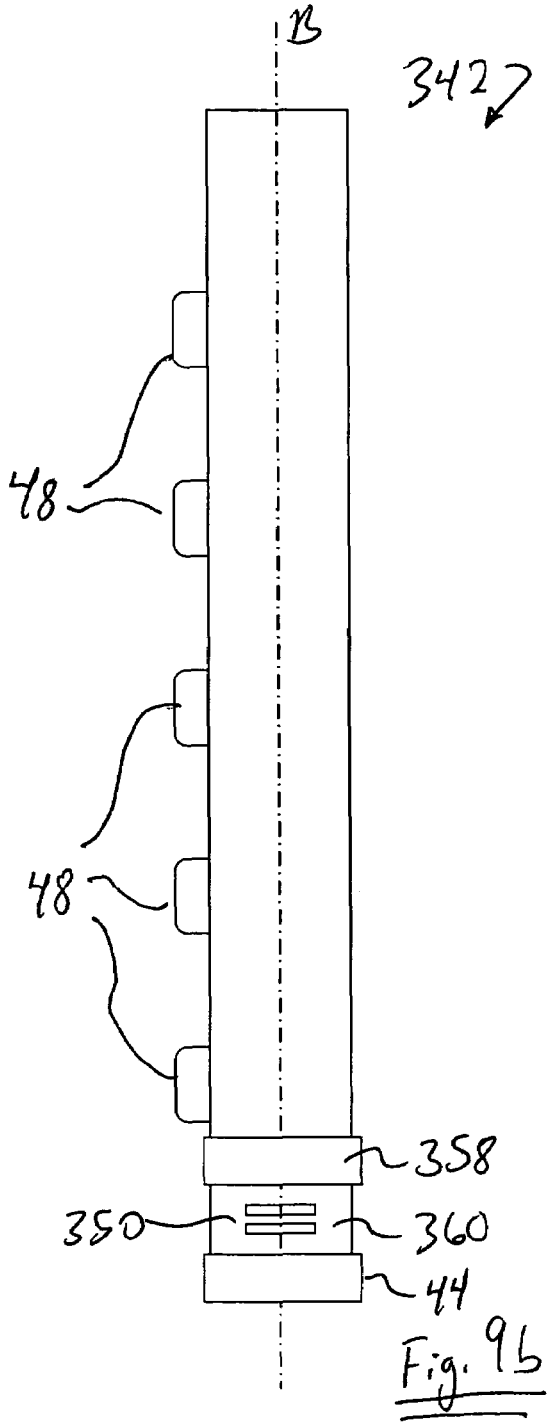

In a further embodiment shown in FIGS. 9*a* and 9*b*, the jet tube 342 has no slots 50 or 52. One end of the jet tube 342 is affixed to the coupler 40 and the opposite end is affixed to a collar 358. A jet tube extension 360 is affixed to the collar 358 and the end cap 44 is affixed to the jet tube extension 360. A set of slots 350 are located in the jet tube extension 360. Thus, the jet tube 342 of the present embodiment includes only one set of slots. The jet tube 342 is oriented with the nozzles 48 directed away from the skimmer/pool outlet 26 and then the jet tube extension 360 is affixed to the collar 358 with the slots 350 oriented to direct the pressurized water toward the center of the pool 12.

Figure 10A:
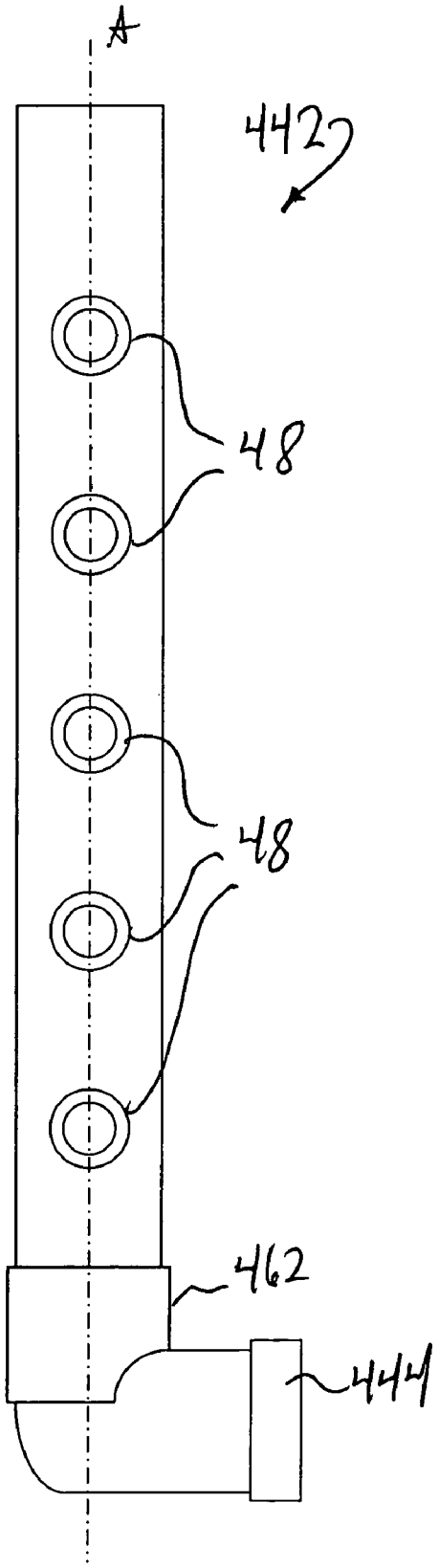
FIGS. 10*a* and 10*b* are side views of a jet tube having a redirecting elbow according to a further embodiment of the invention.
Figure 10B:
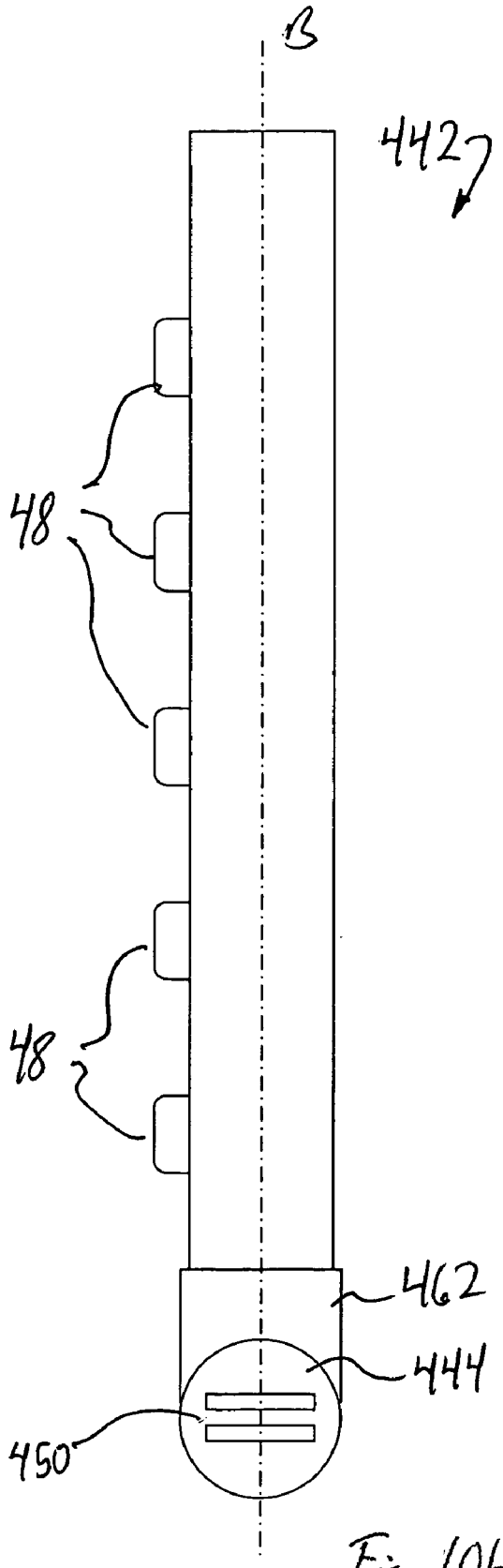

In a further embodiment shown in FIGS. 10*a* and 10*b*, jet tube 442 does not include slots 50, 52, and end cap 44 is left off. Similarly to previously described embodiments, the jet tube 442 is affixed to the coupler 40 and includes nozzles 48. The jet tube 442 is positioned such that the nozzles 48 are aimed parallel to the side wall 20 and face away from the skimmer/pool outlet 26. A redirecting elbow 462 is affixed to the open end of the jet tube 442 such that the open end of the redirecting elbow 462 is directed towards the center of the pool 12. An end cap 444 having slots 450 is affixed to the open end of the redirecting elbow 462.

It should be particularly noted that several components of the water circulator in the examples provided may be combined into a single component. For example, the adaptor 36, elbow 38, short tube 46, and coupler 40 of the first embodiment may be a single molded piece rather than the multiple components described.

While the invention has been described with reference to preferred embodiments, it will be understood by those skilled in the art that various changes may be made and equivalents may be substituted for elements thereof without departing from the scope of the invention. In addition, many modifications may be made to adapt a particular situation or material to the teachings of the invention without departing from the scope of the invention.

Therefore, it is intended that the invention not be limited to the particular embodiments disclosed as the best mode contemplated for carrying out this invention, but that the invention will include all embodiments falling within the scope and spirit of the appended claims.

The invention claimed is:

1. A swimming pool water circulating apparatus for the circulation of substantially all water in an above-ground pool having a floor and a continuously curved side wall with a pressurized water inlet and a water outlet both in the side wall and proximate to the surface of the pool water with the outlet in the direction of circulation being downstream of the inlet, the apparatus comprising:

a rigid hollow jet tube at least partially submerged in the water and in fluid communication with the water inlet, the jet tube being adjacent to a portion of a pool side wall and extending substantially vertically in the pool and substantially entirely along the side wall from the water surface to the pool floor;

means defining a plurality of nozzles penetrating said tube along substantially the entire length of the jet tube that is under the surface of the water and through which water from the water inlet flows through the nozzles directly into the pool water to cause a current that circulates the pool water and any debris along the side wall to the water outlet to discharge the debris from the pool, the nozzles being disposed along a vertical centerline aligned with the vertical jet tube and directed to produce jets of water from the water inlet parallel to and substantially along the entire periphery of the side wall to the water outlet;

means defining at least one slot at the bottom end of the jet tube and proximate to the pool floor, the slot being directed to produce a water jet substantially horizontally along the pool floor toward the center of the pool to cause any debris on the pool floor to be picked up by the current caused by the nozzles; and means providing water-tight connections enabling water from the water inlet to flow only through the nozzles and the slot, the water-tight means comprising an end cap at the bottom end of the jet tube and a rigid elbow-shaped water-tight adaptor connecting the top of the jet tube to the water inlet.

2. The water circulating system of claim 1, further comprising:

a pump in fluid communication with the water outlet and the water inlet of said pool;

a strainer situated between said water outlet and said pump; and a filter situated between said strainer and said pump.

3. The water circulating apparatus of claim 1, wherein the nozzles are evenly spaced along the length of the jet tube.

4. The water circulating apparatus of claim 1, comprising two slots at the bottom end of the jet tube.

5. The water circulating apparatus of claim 1, the nozzles being detachable from the jet tube and extending a short distance from the jet tube.

6. The water circulating apparatus of claim 5, the nozzles being evenly spaced along the length of the jet tube.

7. The water circulating apparatus of claim 6 wherein each nozzle includes a barb for retaining the nozzle in the jet tube.

8. The water circulating apparatus of claim 1, the water-tight means further comprising:

a through-the-wall assembly engaging the water inlet and in communication with a filter and pump assembly; and a second adaptor having one end mating with the through-the-wall assembly and another end mating with the elbow-shaped water-tight adaptor.

9. The water circulating apparatus of claim 1, the water-tight means further comprising:

a short tube having a water-tight fit with the downward-directed end of the elbow-shaped water-tight adaptor and being secured thereto; and a coupler in water-tight engagement with the short tube at one end and in water-tight engagement with the jet tube at the other end.

10. The water circulating apparatus of claim 1, the elbow-shaped water-tight adaptor having a 90-degree bend.

* * * * *